US011040235B2

(12) United States Patent
Wang

(10) Patent No.: US 11,040,235 B2
(45) Date of Patent: Jun. 22, 2021

(54) DUMBBELL ASSEMBLY

(71) Applicant: BETO ENGINEERING AND MARKETING CO., LTD., Taichung (TW)

(72) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 0 days.

(21) Appl. No.: 16/781,285

(22) Filed: Feb. 4, 2020

(65) Prior Publication Data

US 2020/0398100 A1 Dec. 24, 2020

(30) Foreign Application Priority Data

Jun. 18, 2019 (TW) ..... 108121071

(51) Int. Cl.
*A63B 21/072* (2006.01)
*A63B 21/078* (2006.01)
*A63B 21/075* (2006.01)

(52) U.S. Cl.
CPC ..... *A63B 21/0726* (2013.01); *A63B 21/075* (2013.01); *A63B 21/078* (2013.01); *A63B 21/0728* (2013.01)

(58) Field of Classification Search
CPC ... A61B 21/075; A61B 21/0724; A61B 23/12; A61B 21/4043; A61B 21/00065; A61B 21/0728; A61B 21/0726; A61B 21/00061; A61B 21/00069; A61B 21/4035
See application file for complete search history.

(56) References Cited

U.S. PATENT DOCUMENTS 4,029,312 A * 6/1977 Wright ..... A63B 21/0602 482/108
4,743,017 A * 5/1988 Jaeger ..... A63B 21/075 482/108
4,768,780 A * 9/1988 Hayes ..... A63B 21/0724 482/106
D315,003 S * 2/1991 Huang ..... D21/682
(Continued)

FOREIGN PATENT DOCUMENTS

CN 206762119 U 12/2017
TW 201725062 A 7/2017
WO 2008071029 A1 6/2008

OTHER PUBLICATIONS

Search Report appended to an Office Action, which was issued to Taiwanese counterpart application No. 108121071 by the TIPO dated Apr. 8, 2020 with an English translation thereof.

*Primary Examiner* — Garrett K Atkinson
(74) *Attorney, Agent, or Firm* — Muncy, Geissler, Olds & Lowe, P.C.

(57) ABSTRACT

A dumbbell assembly includes a base seat having two receiving areas, two weight units respectively received in the receiving areas, and a dumbbell. Each weight unit includes a plurality of weight blocks each having at least one engaging hole. The dumbbell includes a handle, and two weight adjustment modules each including an insertion base, and a plurality of engaging units each including a drive component mounted on the handle, and at least one insertion pin connected to the drive component. The handle is rotatable relative to the weight adjustment modules to drive each engaging unit to move between an engaging state and a disengaging state.

10 Claims, 22 Drawing Sheets

(56) References Cited

U.S. PATENT DOCUMENTS 5,033,739 A * 7/1991 MacKechnie .... A63B 21/00069 482/111
5,407,413 A * 4/1995 Kupferman ..... A63B 21/0728 482/106
5,637,064 A * 6/1997 Olson ..... A63B 21/0728 482/107
5,779,604 A * 7/1998 Towley, III ..... A63B 21/0728 482/107
6,149,558 A * 11/2000 Chen ..... A63B 21/0728 482/107
6,186,928 B1 * 2/2001 Chen ..... A63B 21/0728 482/107
6,196,952 B1 * 3/2001 Chen ..... A63B 21/0728 482/107
6,500,101 B1 * 12/2002 Chen ..... A63B 21/0728 482/107
6,656,093 B2 * 12/2003 Chen ..... A63B 21/075 482/107
D498,272 S * 11/2004 Sanford-Schwentke .... D21/681
6,971,974 B2 * 12/2005 Bowman ..... A63B 21/0728 482/106
7,090,625 B2 * 8/2006 Chermack ..... A63B 21/075 482/107
7,223,214 B2 * 5/2007 Chen ..... A63B 21/075 482/107
7,413,533 B2 * 8/2008 Lin ..... A63B 21/075 482/106
7,578,772 B2 * 8/2009 Lippitt ..... A63B 21/0728 482/106
7,604,578 B2 * 10/2009 Liu ..... A63B 21/075 482/106
7,704,197 B2 * 4/2010 Yu ..... A63B 21/063 482/108
7,731,641 B1 * 6/2010 Chen ..... A63B 21/0728 482/108
7,811,213 B2 * 10/2010 Chen ..... A63B 21/075 482/108
D643,481 S * 8/2011 Rauwerdink ..... D21/681
8,025,613 B1 * 9/2011 Wang ..... A63B 21/0726 482/107
D651,672 S * 1/2012 Towley, III ..... D21/681
8,668,630 B2 * 3/2014 Towley, III ..... A63B 21/075 482/93
8,715,143 B2 * 5/2014 Svenberg ..... A63B 21/0728 482/108
9,011,299 B2 * 4/2015 Lien ..... A63B 21/075 482/108
9,375,602 B2 * 6/2016 Krull ..... A63B 21/075
9,604,092 B2 * 3/2017 Krull ..... A63B 24/0062
9,616,273 B2 * 4/2017 Chen ..... A63B 21/075
9,713,736 B2 * 7/2017 Kao ..... A63B 23/12
9,943,719 B2 * 4/2018 Smith ..... A63B 21/075
9,956,451 B1 * 5/2018 Wang ..... A63B 21/0728
10,166,431 B2 * 1/2019 Towley, III ..... A63B 21/0726
10,518,123 B2 * 12/2019 Moran ..... A63B 21/075
10,843,027 B2 * 11/2020 Wang ..... A63B 21/0728
10,864,403 B2 * 12/2020 Towley, III ..... A63B 21/0728
2009/0042700 A1 * 2/2009 Liu ..... A63B 21/075 482/107
2012/0021877 A1 * 1/2012 Lundquist ..... A63B 21/075 482/107
2017/0050073 A1 * 2/2017 Kao ..... A63B 21/0728
2018/0264308 A1 * 9/2018 Wang ..... A63B 71/0036

* cited by examiner

DUMBBELL ASSEMBLY

CROSS-REFERENCE TO RELATED APPLICATION

This application claims priority of Taiwanese Patent Application No. 108121071, filed on Jun. 18, 2019.

FIELD

The disclosure relates to a fitness equipment, more particularly to a dumbbell assembly with adjustable weights.

BACKGROUND

Dumbbell is an exercise equipment for training hand muscles, and is usually equipped with a single weight which cannot be changed. If a user needs to adjust different exercise intensity, he/she needs to prepare many dumbbells with different weights simultaneously. This not only results in waste of money, but is also difficult to store.

A dumbbell assembly is disclosed in Taiwanese Patent Publication No. TW201725062, and mainly includes a base seat and a dumbbell. The dumbbell includes a handle and two weight units respectively disposed on two opposite ends of the handle. Each weight unit includes a plurality of hook discs rotatable along with the handle, and a plurality of weight blocks. Each hook disc has a hooking unit which includes at least one protruding portion and at least one gap besides the at least one protruding portion. Each weight block has a hooking protrusion. Rotating the handle can adjust the relative position between the at least one protruding portion and the at least one gap of the hook discs and the hooking protrusion, so that the weight blocks can be selectively mounted to the handle or detached from the handle so as to be placed in the receiving seat, thereby achieving the effect of adjusting the weights of the dumbbell.

Although the aforementioned dumbbell assembly can achieve its intended purpose, since each weight block is connected to a corresponding one of the hook discs through the hooking protrusion thereof, the weight of the weight block is thus concentrated on the hooking protrusion, and since the hooking protrusion is not connected as one piece with the main body of the weight block, if there are defects during making of the hooking protrusion and the main body of the weight block, the hooking protrusion is easily broken and removed from the main body of the weight block. If the breakage takes place during exercise, the weight block directly falls downward, and potential hazard may take place.

SUMMARY

Therefore, an object of the present disclosure is to provide a dumbbell assembly that is capable of alleviating at least one of the drawbacks of the prior art.

According to this disclosure, a dumbbell assembly comprises a base seat extending along a left-right direction, two weight units and a dumbbell. The base seat includes a main seat body having two receiving areas formed in a top surface thereof and spaced apart from each other in the left-right direction. Each receiving area has a plurality of receiving grooves arranged spaced apart from one another along the left-right direction. The weight units are respectively disposed in the receiving areas. Each weight unit includes a plurality of weight blocks received respectively and removably in the receiving grooves of a respective one of the receiving areas. Each weight block has at least one engaging hole.

The dumbbell includes a handle extending in the left-right direction, and two weight adjustment modules respectively disposed on two opposite ends of the handle and respectively corresponding to the weight units. Each weight adjustment module includes an insertion base defining a plurality of adjustment spaces arranged spaced apart from one another along the left-right direction, and a plurality of engaging units respectively received in the adjustment spaces and respectively corresponding to the weight blocks of a respective weight unit. Each engaging unit includes a drive component mounted on the handle, and at least one insertion pin resiliently connected to the drive component and corresponding to the at least one engaging hole. When the handle is rotated relative to the weight adjustment modules, the handle drives each engaging unit to move between an engaging state and a disengaging state.

When each engaging unit is in the engaging state, the at least one insertion pin is driven by the drive component to protrude out of the insertion base and engage with the at least one engaging hole in a corresponding one of the weight blocks, thereby connecting the insertion base with the corresponding weight block; and, when each engaging unit is in the disengaging state, the at least one insertion pin is retracted into the insertion base and is moved away from the at least one engaging hole in the corresponding one of the weight blocks, thereby disconnecting the insertion base with the corresponding weight block.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
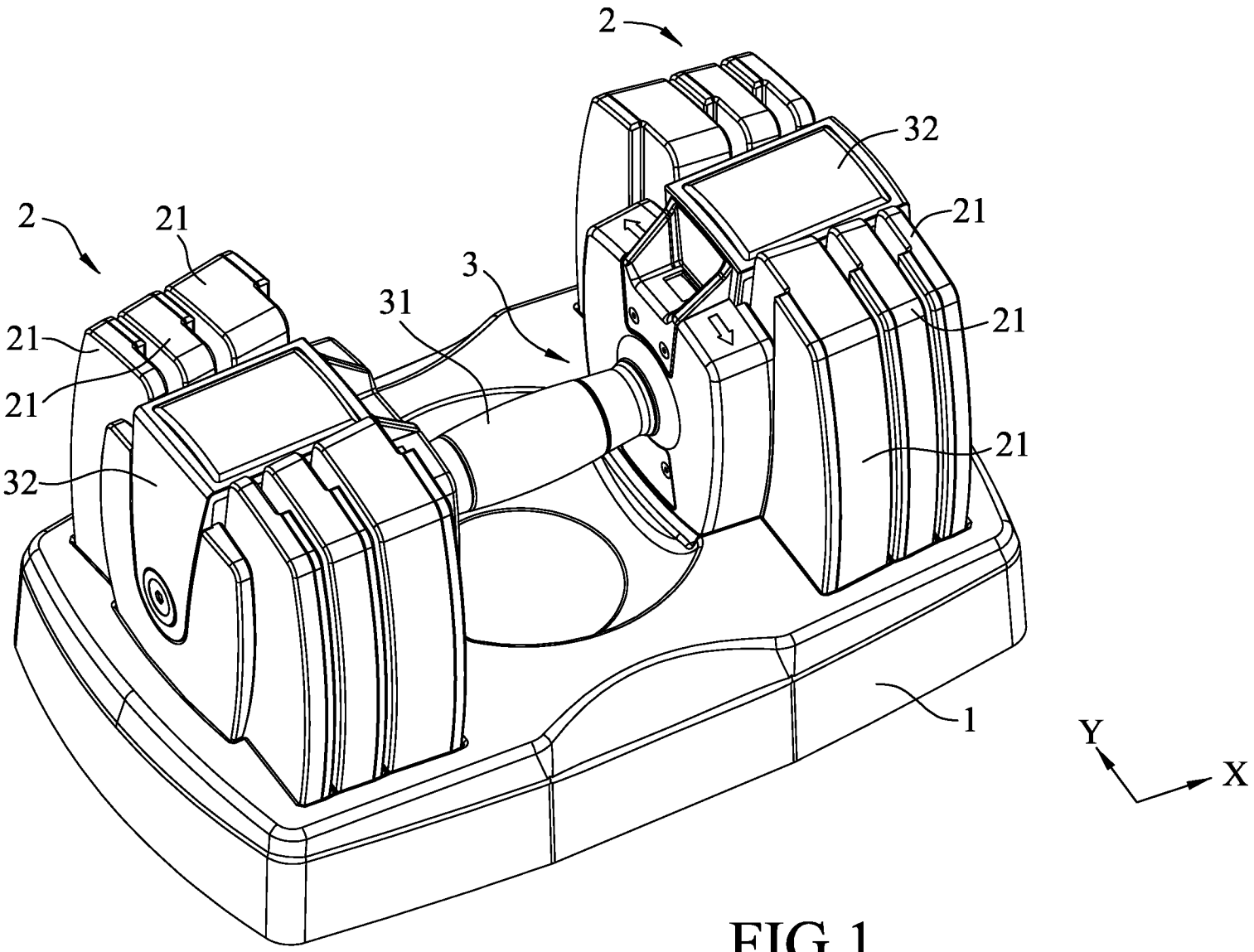
FIG. 1 is a perspective view of a dumbbell assembly according to an embodiment of the present disclosure.
Figure 2:
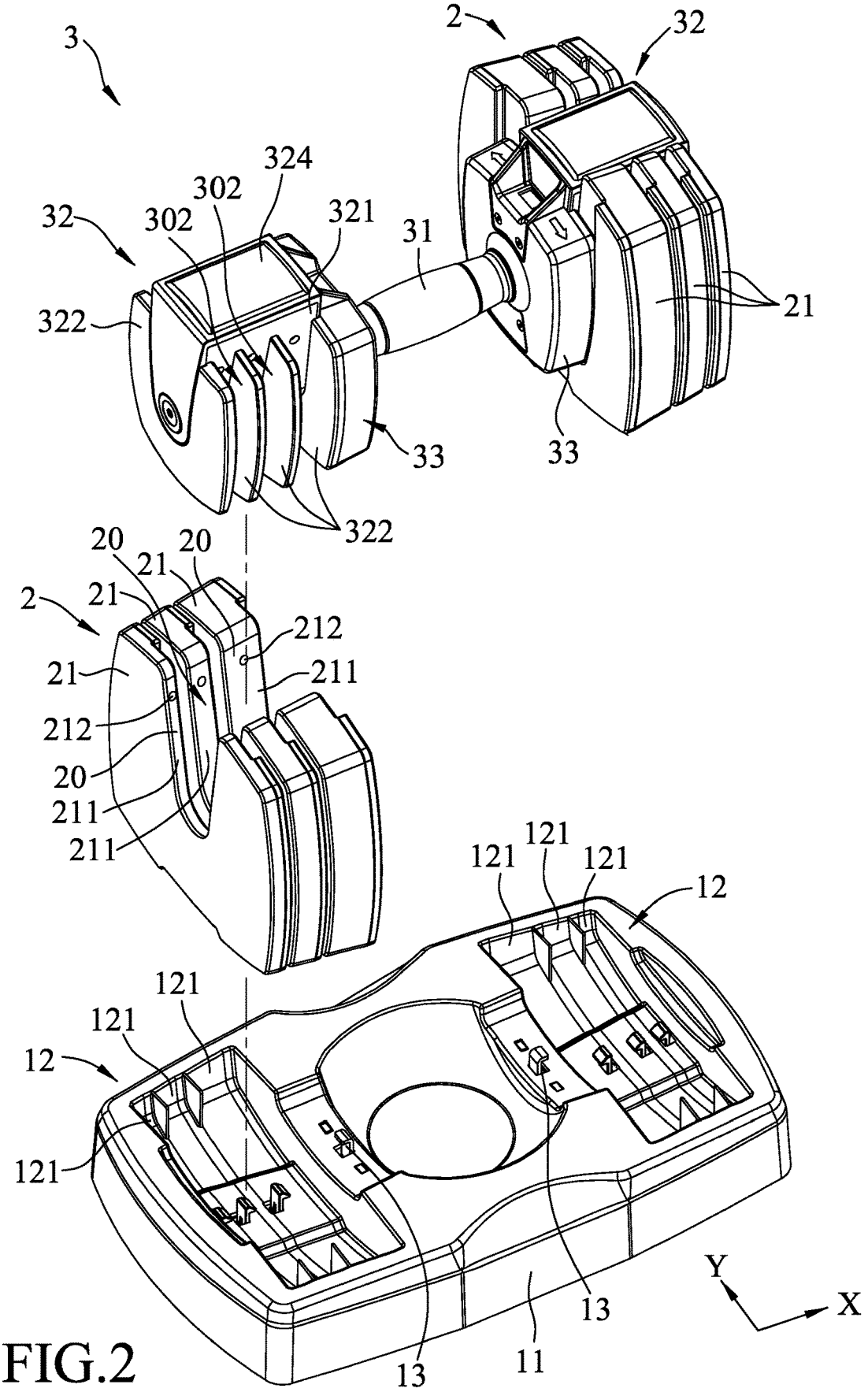
FIG. 2 is an exploded perspective view of the embodiment, illustrating a configuration relationship among a base seat, two weight units and a dumbbell.
Figure 3:
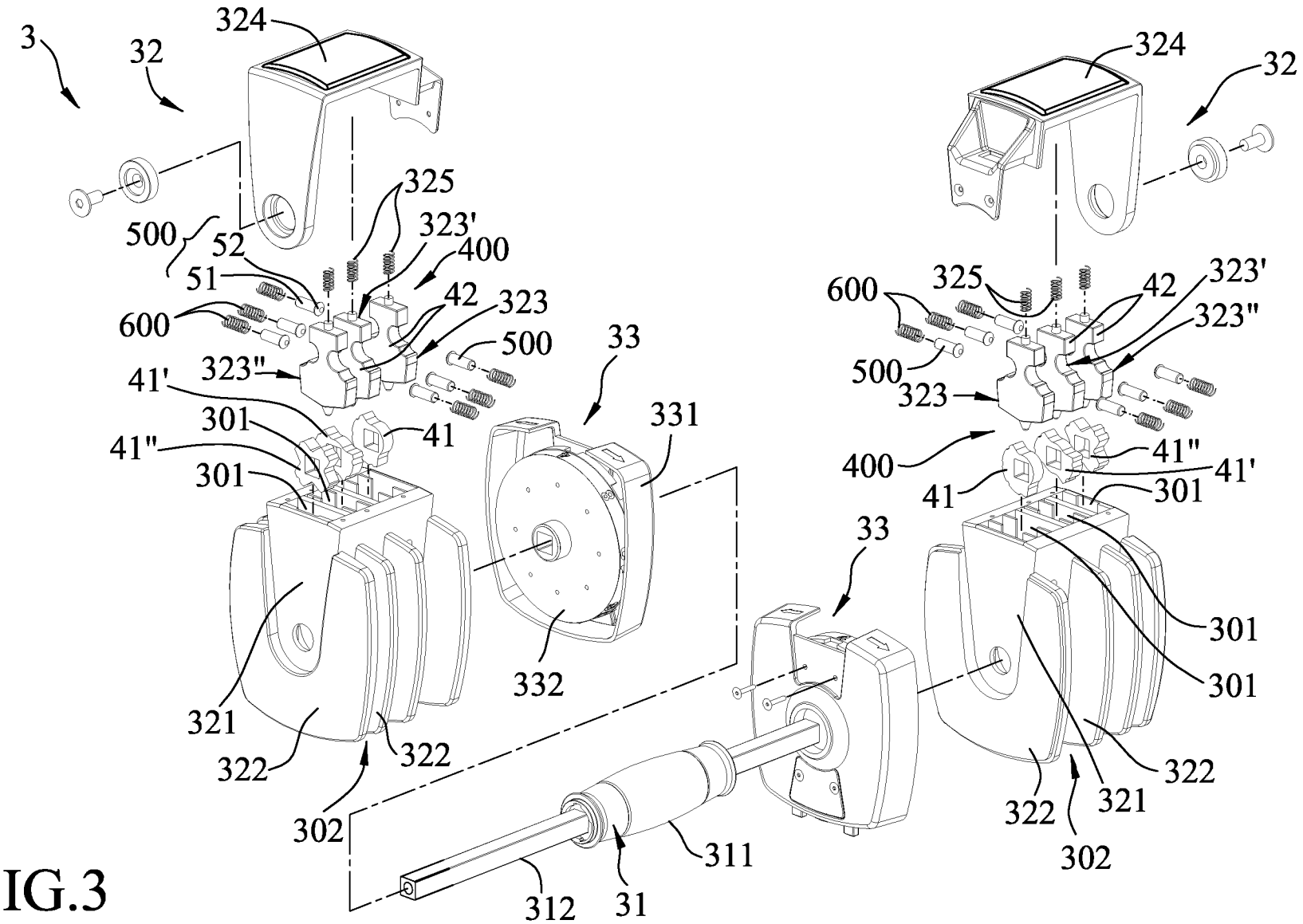
FIG. 3 is an exploded perspective view of the dumbbell of the embodiment.
Figure 4:
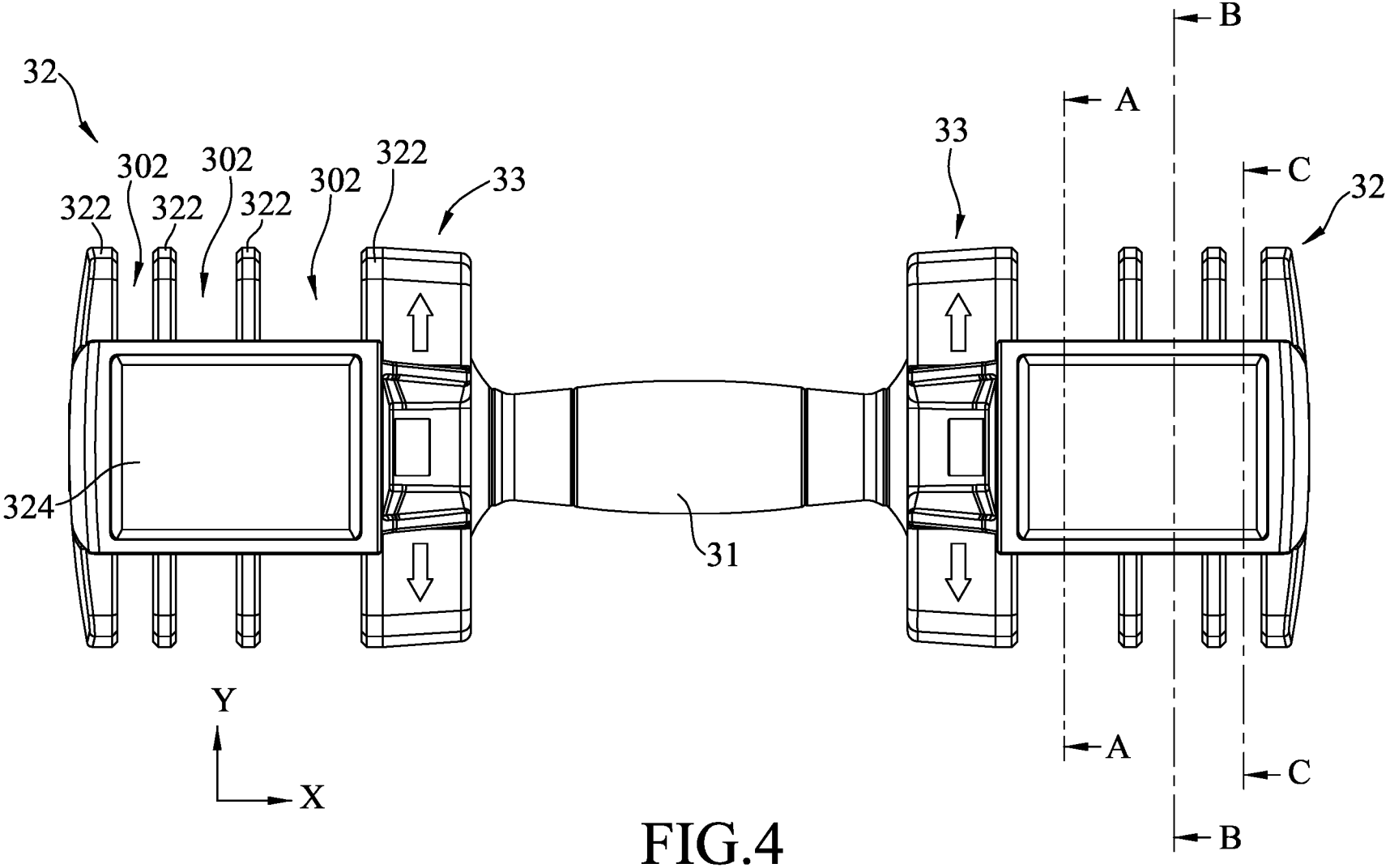
FIG. 4 is a schematic top view of the dumbbell of the embodiment in an assembled state.

Referring to FIGS. 1 to 3, a dumbbell assembly according to an embodiment of the present disclosure is shown to comprise a base seat 1, two weight units 2, and a dumbbell 3.

The base seat 1 extends along a left-right direction (X), and includes a main seat body 11, and two projections 13 protruding out of the main seat body 11. The main seat body 11 has two receiving areas 12 formed in a top surface thereof and spaced apart from each other in the left-right direction (X). Each receiving area 12 has three receiving grooves 121 arranged spaced apart from one another along the left-right direction (X). The projections 13 are located between the receiving areas 12. Specifically, each projection 13 is proximate to a respective one of the receiving areas 12, and has an inverted L-shaped body.

The weight units 2 are respectively disposed in the receiving areas 12. Each weight unit 2 includes three weight blocks 2 received respectively and removably received in the receiving grooves 121 of a respective one of the receiving areas 12. Each weight block 21 has a substantially U-shaped groove wall 211 defining an insertion groove 20 with an opening that faces upward, and two engaging holes 212 (only one is visible in FIG. 2) formed in two opposite ends of the groove wall 211 in proximity to an upper end thereof and spaced apart from each other along a front-rear direction (Y) transverse to the left-right direction (X). The weight blocks 21 of each weight unit 2 have different thicknesses and weights. An outermost one of the weight blocks 21 is the thinnest and the lightest, whereas an innermost one of the weight blocks 21 is the thickest and the heaviest.

The dumbbell 3 includes a handle 31, two weight adjustment modules 32, and two anti-rotation modules 33. The handle 31 extends in the left-right direction (X), and includes a grip portion 311 and a shaft portion 312 extending through the grip portion 311. The weight adjustment modules 32 are respectively mounted on two opposite ends of the shaft portion 312. The anti-rotation modules 33 are respectively connected to the weight adjustment modules 32.

Each weight adjustment module 32 includes a hollow insertion base 321, four substantially U-shaped limiting plates 322 disposed on a bottom portion of the insertion base 321 and spaced apart from one another along the left-right direction (X), three engaging units 323, 323', 323", a top cover 324, and three first elastic members 325. Each two adjacent limiting plates 322 cooperate with the bottom portion of the insertion base 321 to define amounting space 302. Thus, the bottom portion of the insertion base 321 and the limiting plates 322 cooperatively define three mounting spaces 302 spaced apart along the left-right direction (X). The insertion base 321 of each weight adjustment module 32 can be inserted into the insertion grooves 20 of the weight blocks 21 of the corresponding weight unit 2, such that the weight blocks 21 are respectively received in the mounting spaces 302. The insertion base 321 defines three adjustment spaces 301 arranged spaced apart from one another along the left-right direction (X) and respectively having openings that face upward.

The engaging units 323, 323', 323" of each weight adjustment module 32 are respectively disposed in the adjustment spaces 301 of the insertion base 321, and respectively correspond to the weight blocks 21 of each weight unit 2. Each engaging unit 323, 323', 323" includes a drive component 400 mounted on the shaft portion 312 of the handle 31, two insertion pins 500 respectively connected to front and rear sides of the drive component 400, and two second elastic members 600 respectively sleeved on the insertion pins 500. The drive component 400 of each engaging unit 323, 323', 323" has a drive block 41, 41', 41" sleeved on one of the ends of the shaft portion 312 and driven to rotate by the handle 31, and a driven block 42 superposed on and abutting against the drive block 41, 41', 41". The driven block 42 is driven to move up and down relative to the drive block 41, 41' 41" when the latter is rotated by the handle 31. For convenience of illustration, the drive block of the drive component 400 of the engaging unit 323 that is proximate to the grip portion 311 is represented by the reference numeral 41, the drive block of the drive component 400 of the engaging unit 323" that is distal from the grip portion 311 is represented by the reference numeral 41", and the drive block of the drive component 400 of the engaging unit 323' that is disposed between the engaging units 323 and 323" is represented by the reference numeral 41'.

Figure 6:
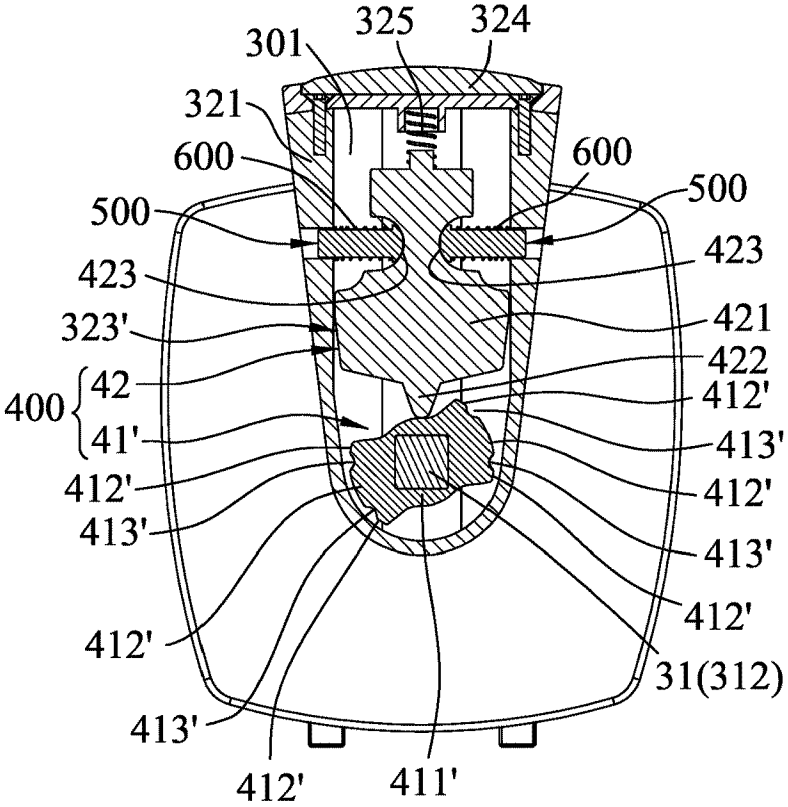
FIG. 6 is a sectional view taken along line B-B of FIG. 4.
Figure 5:
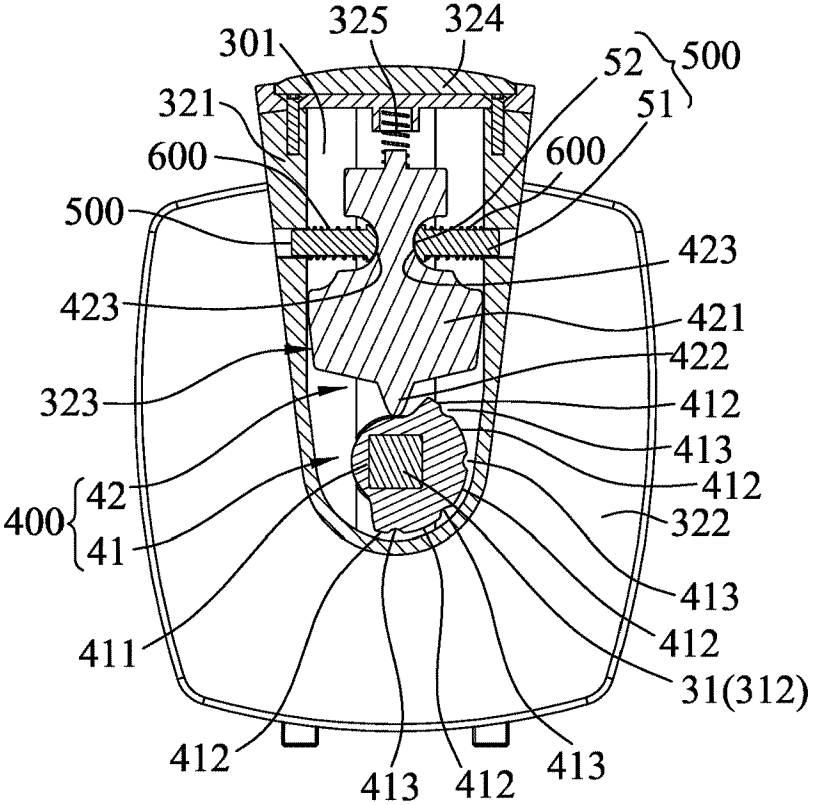
FIG. 5 is a sectional view taken along line A-A of FIG. 4.
Figure 7:
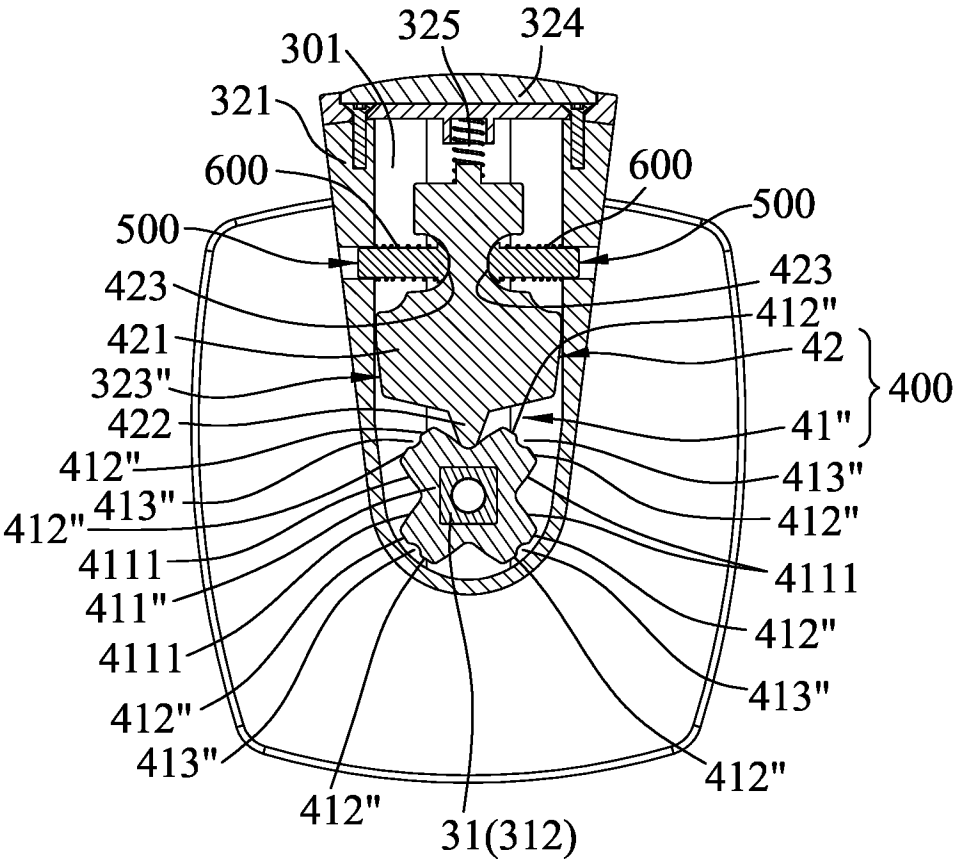
FIG. 7 is a sectional view taken along line C-C of FIG. 4.

Referring to FIGS. 4 to 7, the drive blocks 41, 41', 41" of the engaging units 323, 323', 323" have different shapes. The drive block 41, as shown in FIG. 5, has a substantially sector-shaped drive main body 411, five spaced-apart protruding portions 412 protruding outwardly and integrally from an outer periphery of the drive main body 411, and four positioning recesses 413 extending inwardly from the outer periphery thereof and each of which is located between two adjacent ones of the protruding portions 412. The drive block 41', as shown in FIG. 6 has a substantially rectangular drive main body 411', three protruding portions 412' protruding outwardly and integrally from each short side of the drive main body 411', and four positioning recesses 413' each of which is located between two adjacent ones of the protruding portions 412'. The drive block 41", as shown in FIG. 7, has an X-shaped drive main body 411" including four spaced-apart arms 4111, four pairs of protruding portions 412" each pair of which protrudes outwardly and integrally from a respective one of the arms 4111, and four positioning recesses 413" each of which is located between a respective one of the pairs of protruding portions 412".

Figure 8:
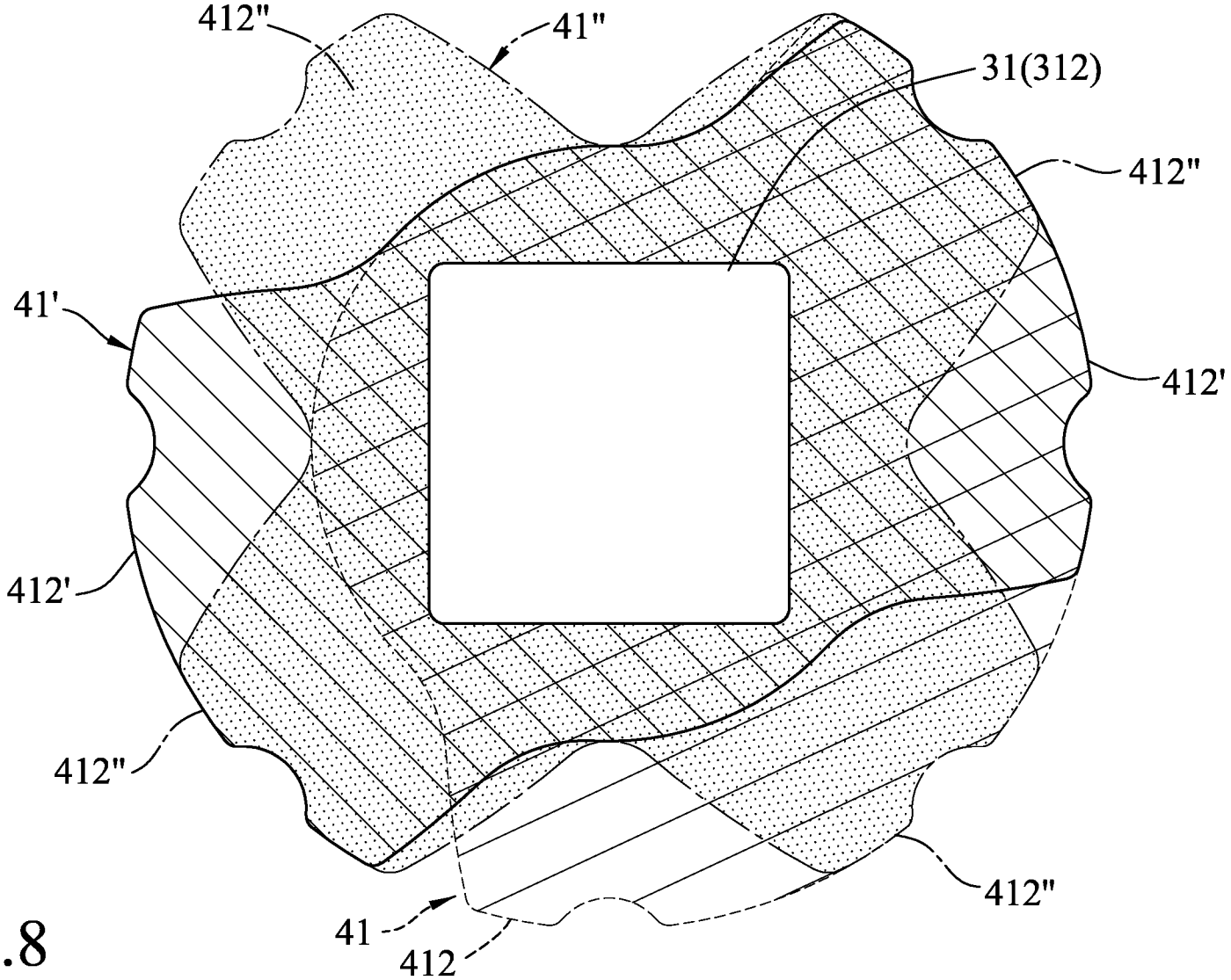
FIG. 8 illustrates drive blocks of engaging units of the embodiment being sleeved on a handle and being overlapped in a left-right direction.
Figure 9:
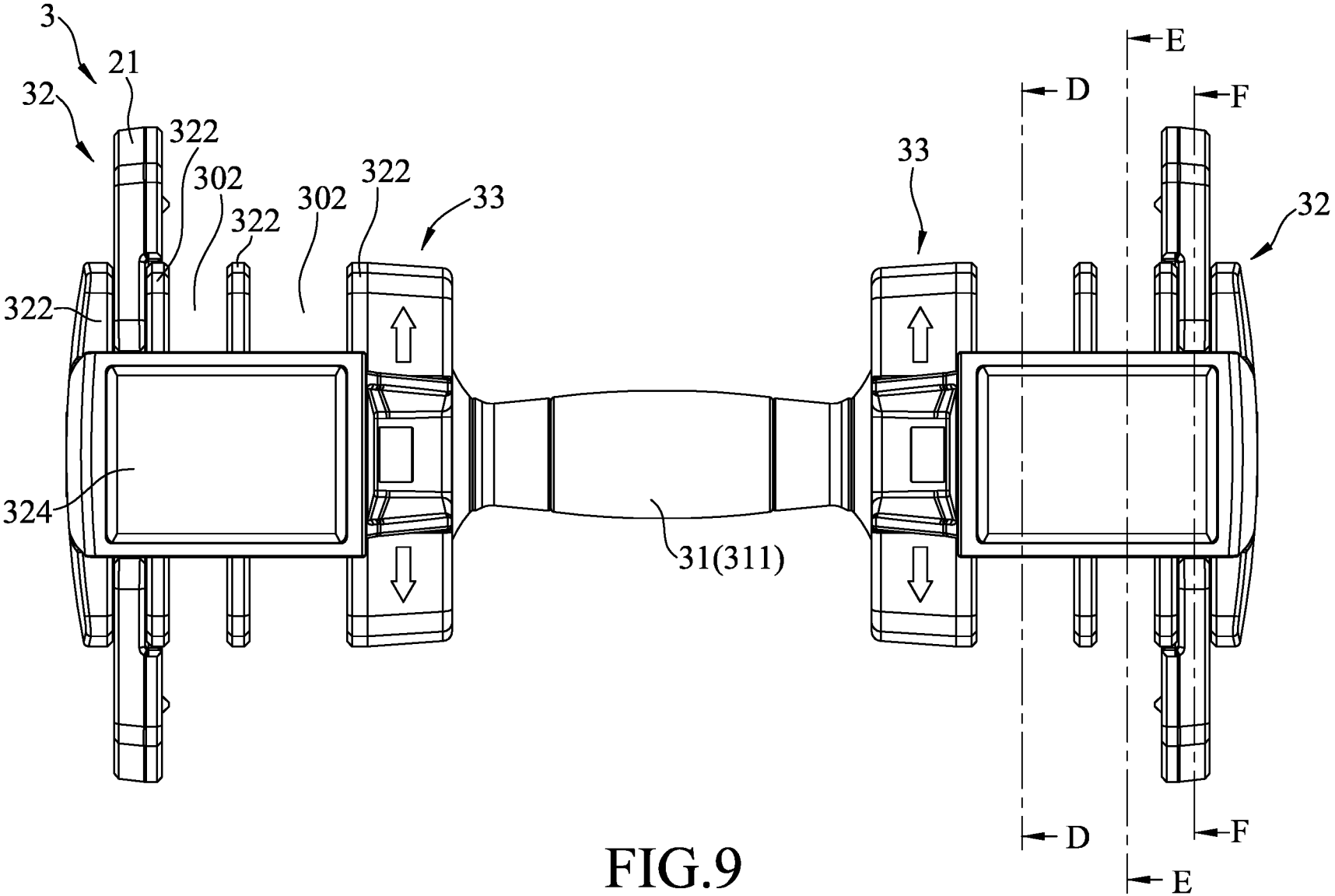
FIG. 9 is a view similar to FIG. 4, but with each side of the dumbbell being mounted with an outermost one of the weight blocks of a corresponding one of the weight units.
Figure 11:
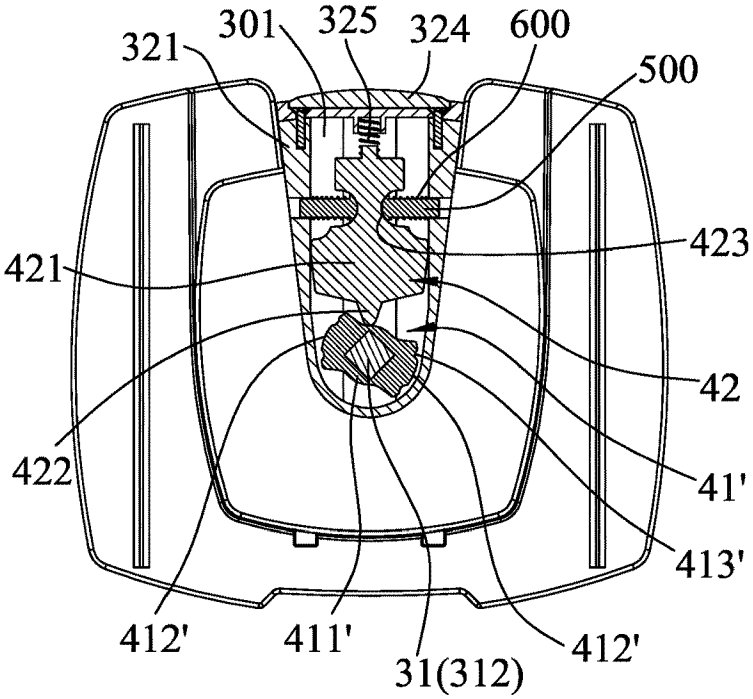
FIG. 11 is a sectional view taken along line E-E of FIG. 9.
Figure 10:
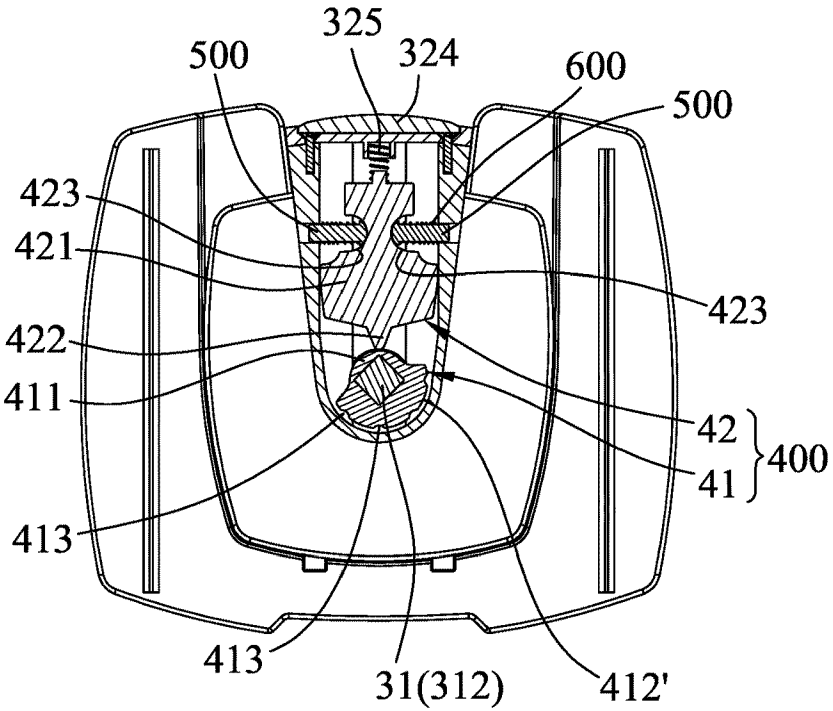
FIG. 10 is a sectional view taken along line D-D of FIG. 9.

FIG. 8 illustrates the drive blocks 41, 41', 41" of the engaging units 323, 323', 323" being sleeved on the shank portion 312 of the handle 31 and being overlapped in the left-right direction (X) (see FIGS. 1 and 2) with the protruding portions 412, 412', 412" of the drive blocks 41, 41', 41" blocking one another.

Referring again to FIGS. 4 to 7, the driven block 42 of each engaging unit 323, 323', 323" has a driven main body 421, and an abutment portion 422 protruding downwardly and integrally from the driven main body 421 and abutting against the drive block 41, 41', 41" of a corresponding one of the engaging units 323, 323', 323". The driven main body 421 has two curved guide notches 423 opposite to each other in the front-rear direction (Y). Each guide notch 423 is defined by a notch-defining surface 4231.

With reference to FIGS. 3 to 7, the insertion pins 500 of each engaging unit 323, 323', 323" are located in a corresponding one of the adjustment spaces 301. Each insertion pin 500 has a curved head portion 52 abutting against the notch-defining surface 4231 of a respective one of the guide notches 423, and a shank portion 51 extending outwardly from the head portion 52 along the front-rear direction (Y) and inserted into the insertion base 321 to position thereat. The second elastic members 600 of each engaging unit 323, 323', 323" are respectively sleeved on the shank portions 51 of the insertion pins 500. Each second elastic member 600 abuts between the head portion 52 and the insertion base 321.

The top cover 324 is mounted on the insertion base 321 and covers the adjustment spaces 301. Each first elastic member 325 is disposed between the top cover 324 and one of the driven blocks 42 of the engaging units 323, 323', 323", and elastically biases the one of the driven blocks 42 downwardly.

Figure 12:
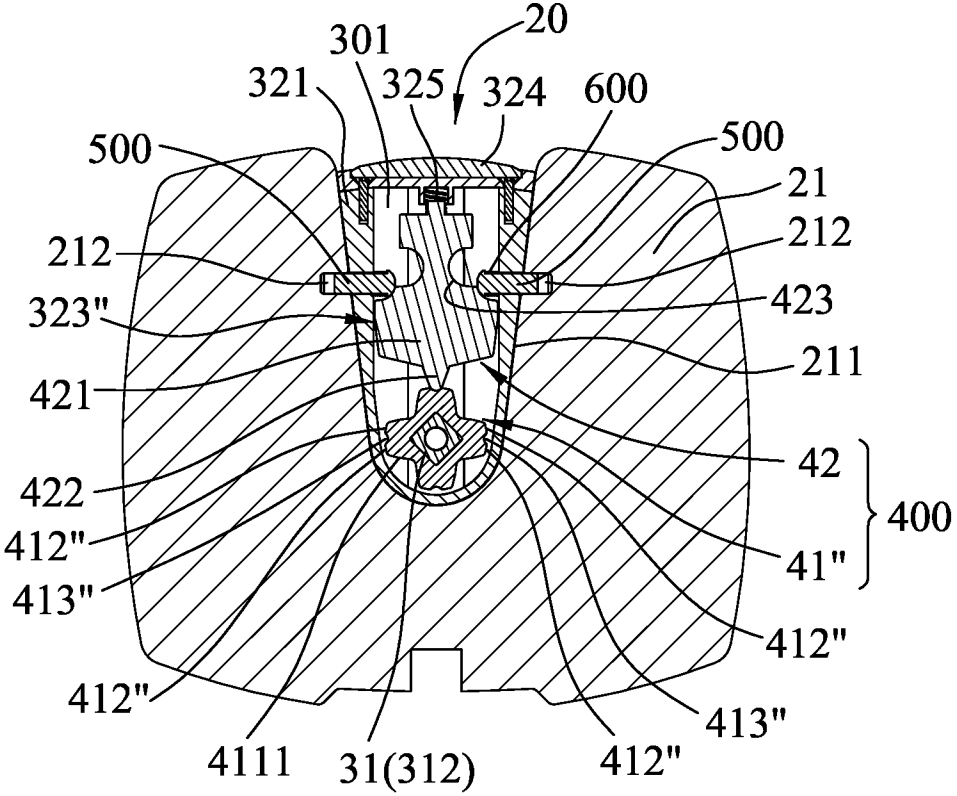
FIG. 12 is a sectional view taken along line F-F of FIG. 9.
Figure 13:
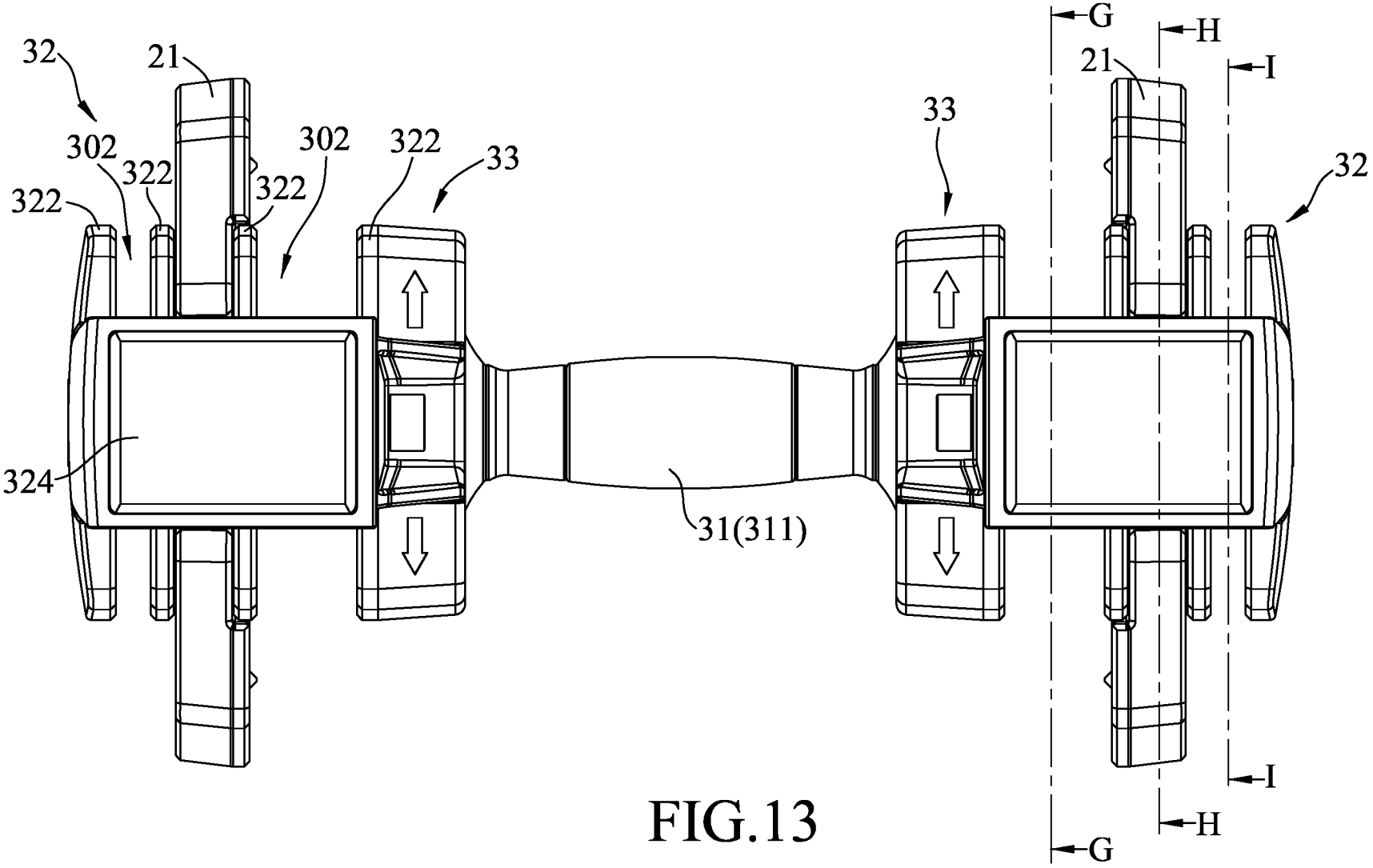
FIG. 13 is a view similar to FIG. 4, but with each side of the dumbbell being mounted with a central one of the weight blocks of the corresponding weight unit.
Figure 15:
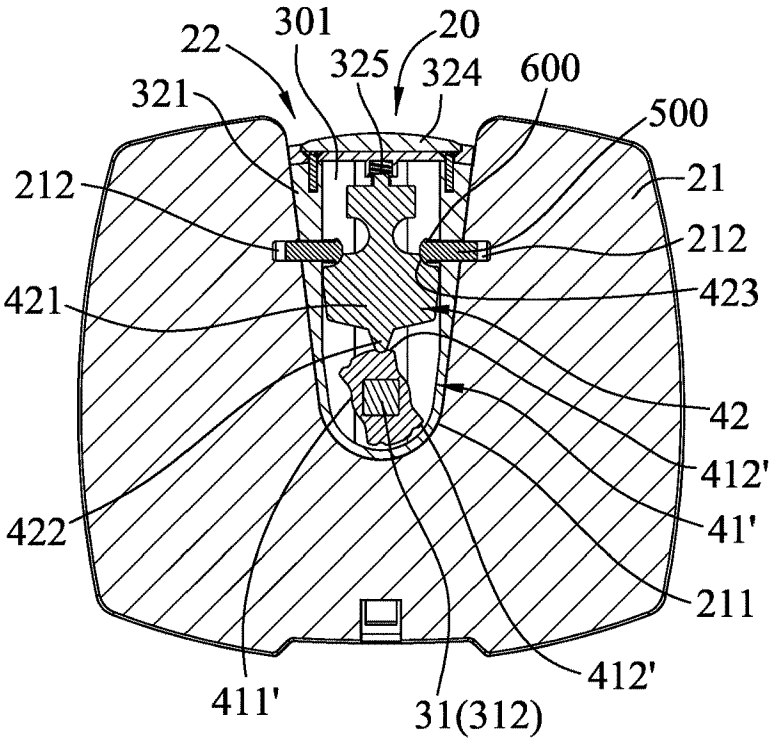
FIG. 15 is a sectional view taken along line H-H of FIG. 13.
Figure 14:
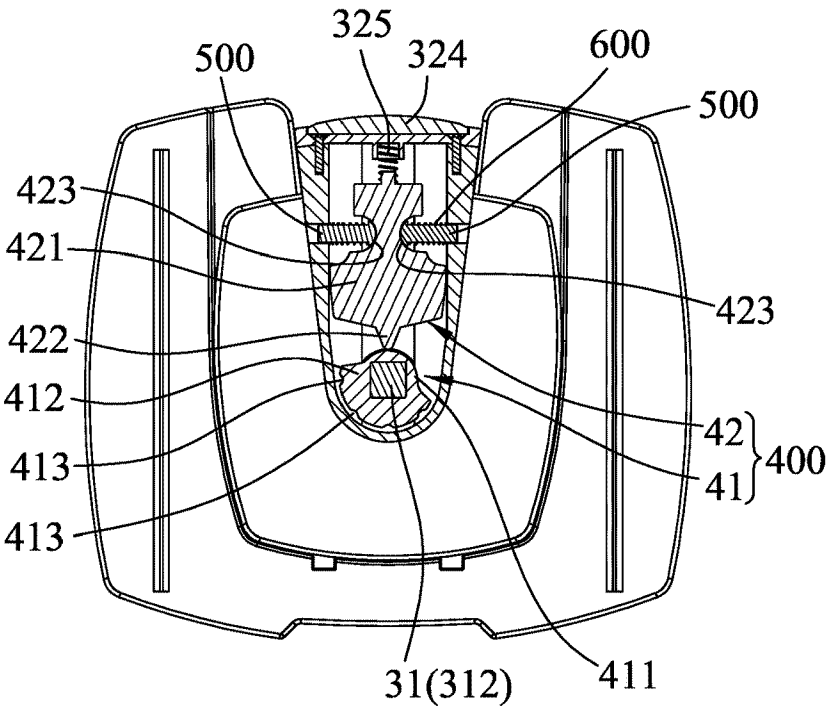
FIG. 14 is a sectional view taken along line G-G of FIG. 13.
Figure 16:
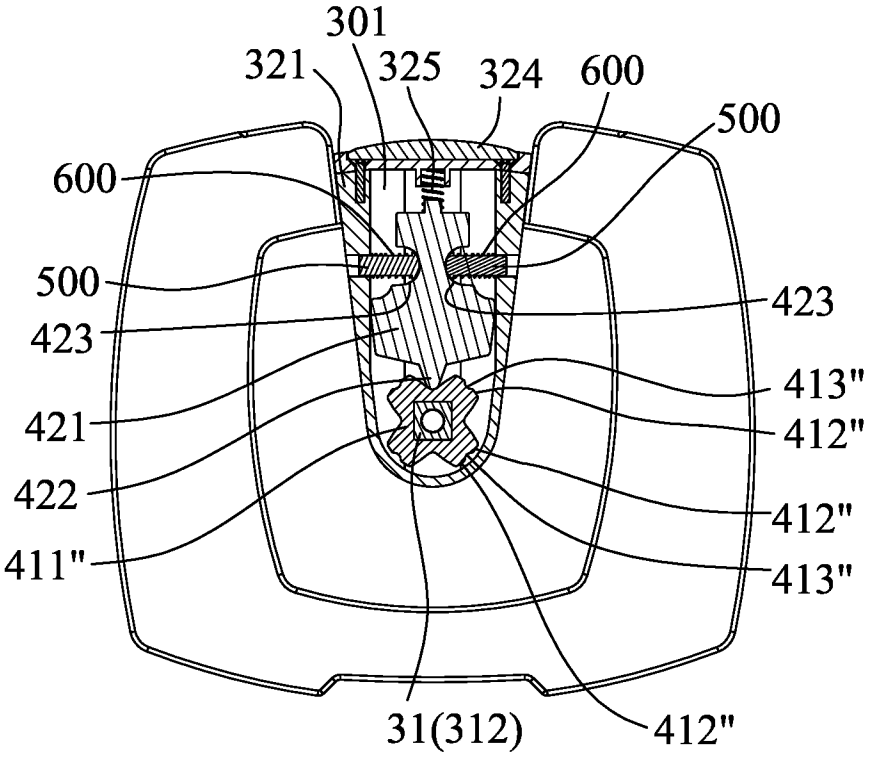
FIG. 16 is a sectional view taken along line I-I of FIG. 13.
Figure 17:
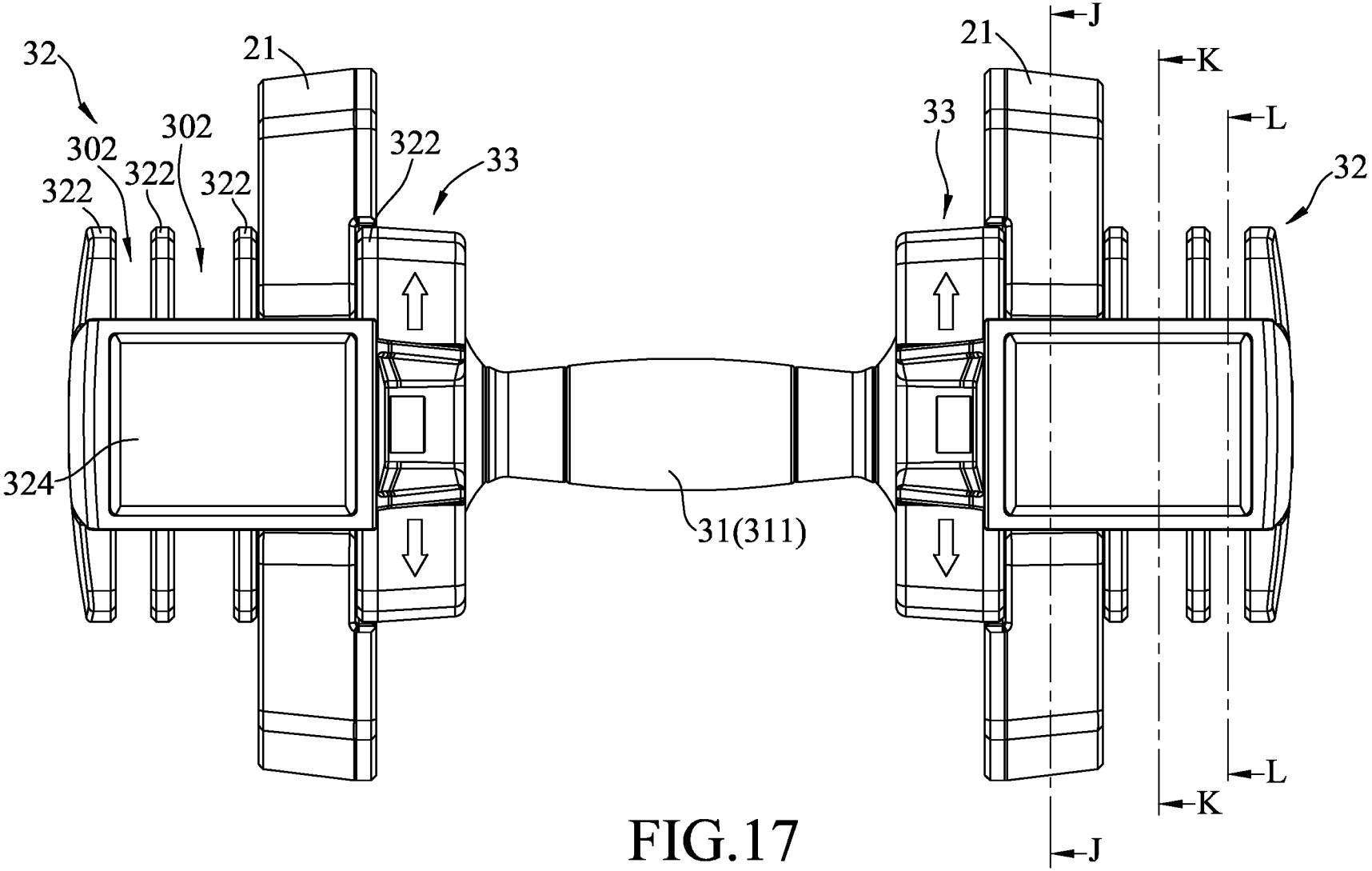
FIG. 17 is a view similar to FIG. 4, but with each side of the dumbbell being mounted with an innermost one of the weight blocks of the corresponding weight unit.
Figure 19:
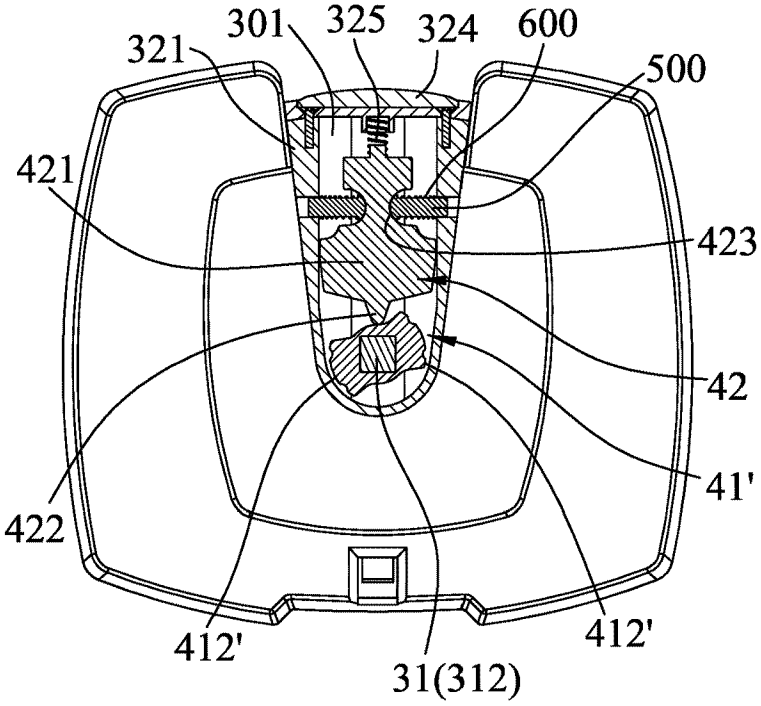
FIG. 19 is a sectional view taken along line K-K of FIG. 17.
Figure 18:
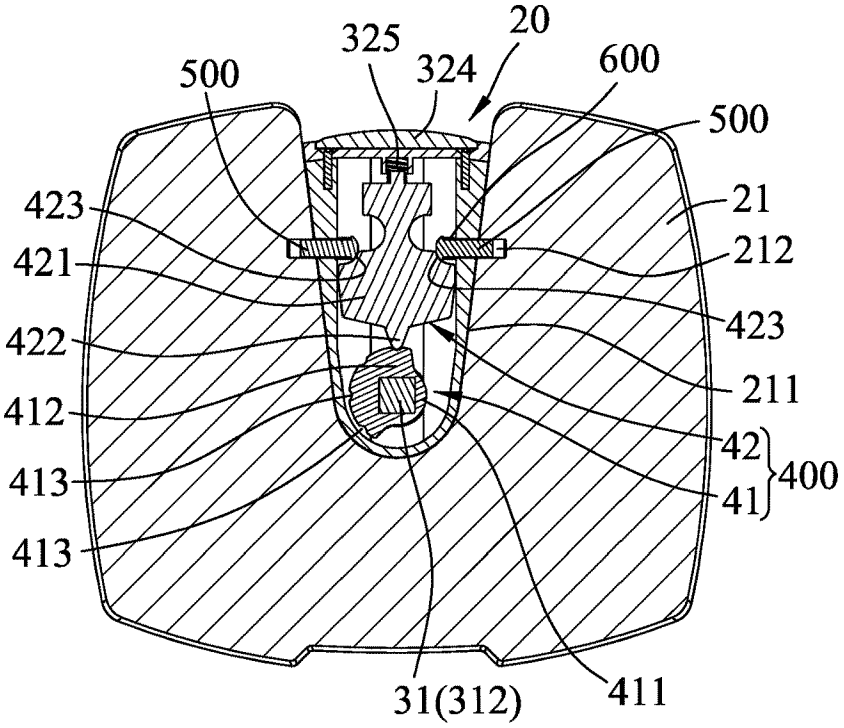
FIG. 18 is a sectional view taken along line J-J of FIG. 17.
Figure 20:
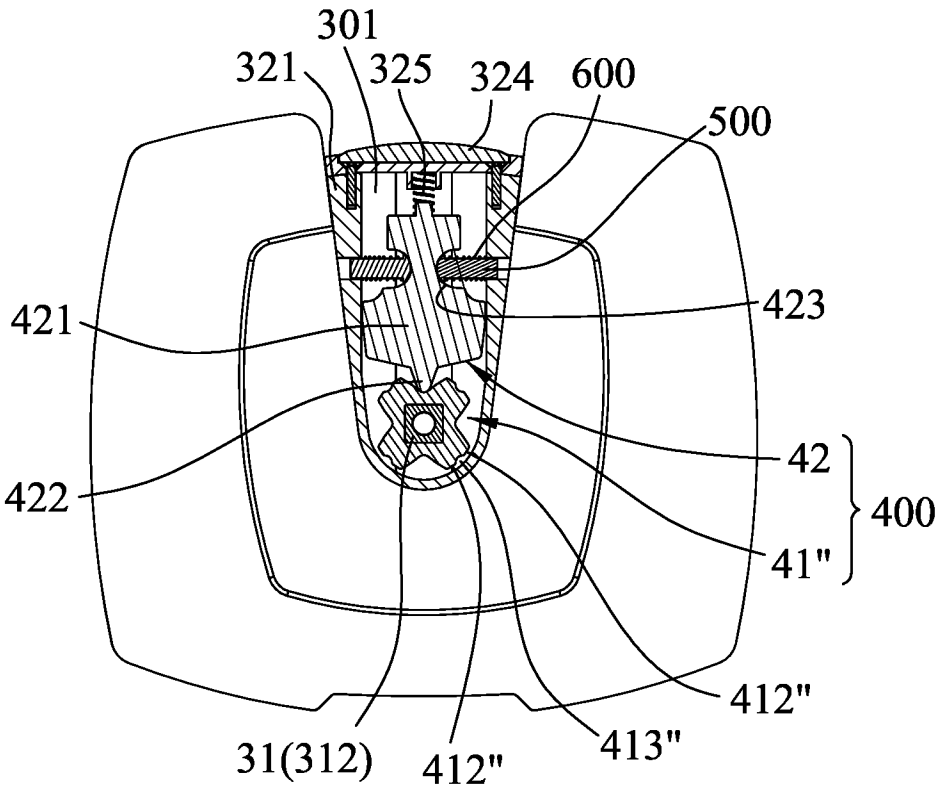
FIG. 20 is a sectional view taken along line L-L of FIG. 17.
Figure 21:
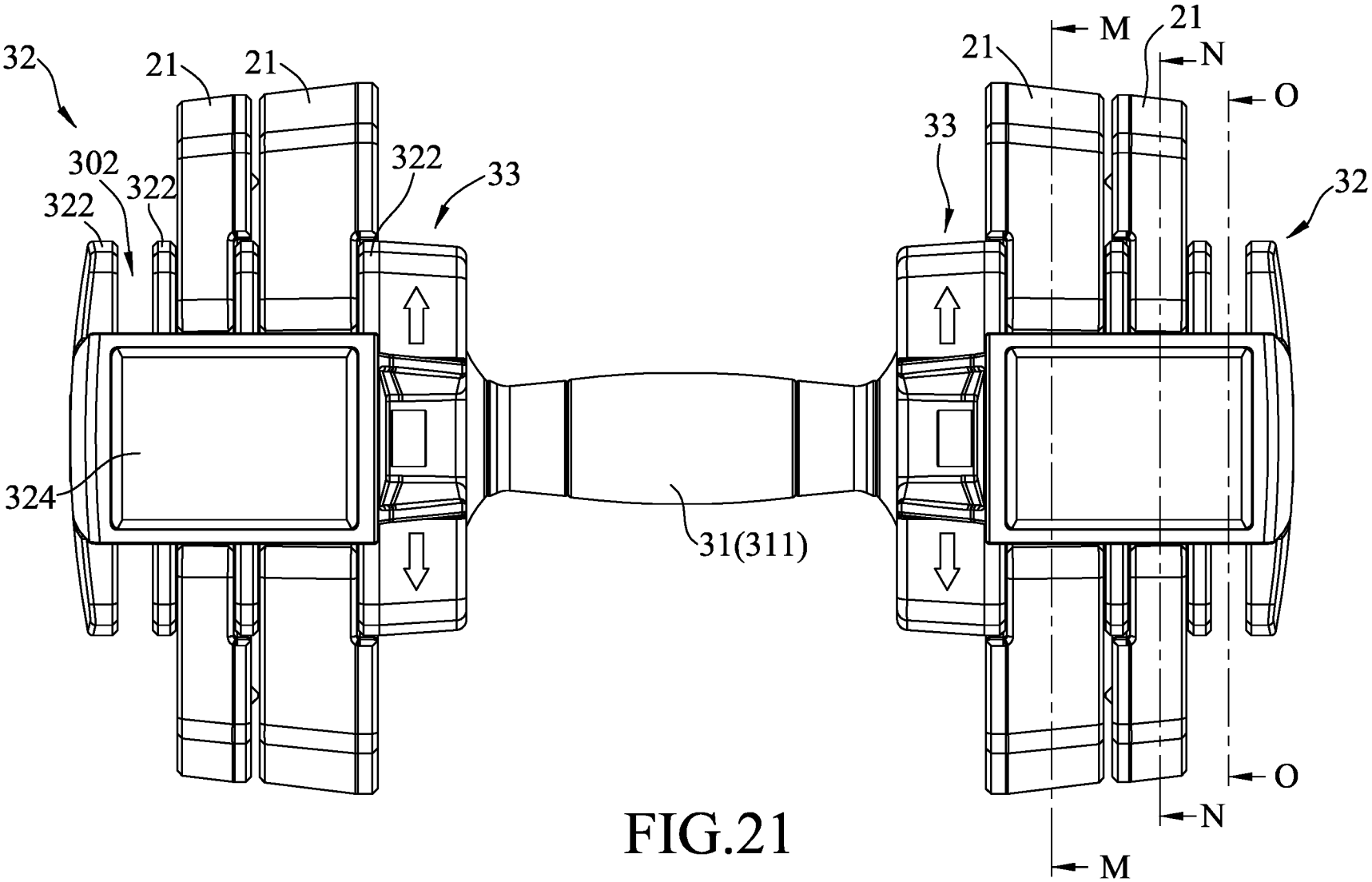
FIG. 21 is a view similar to FIG. 4, but with each side of the dumbbell being mounted with the innermost one and the central one of the weight blocks of the corresponding weight unit.
Figure 23:
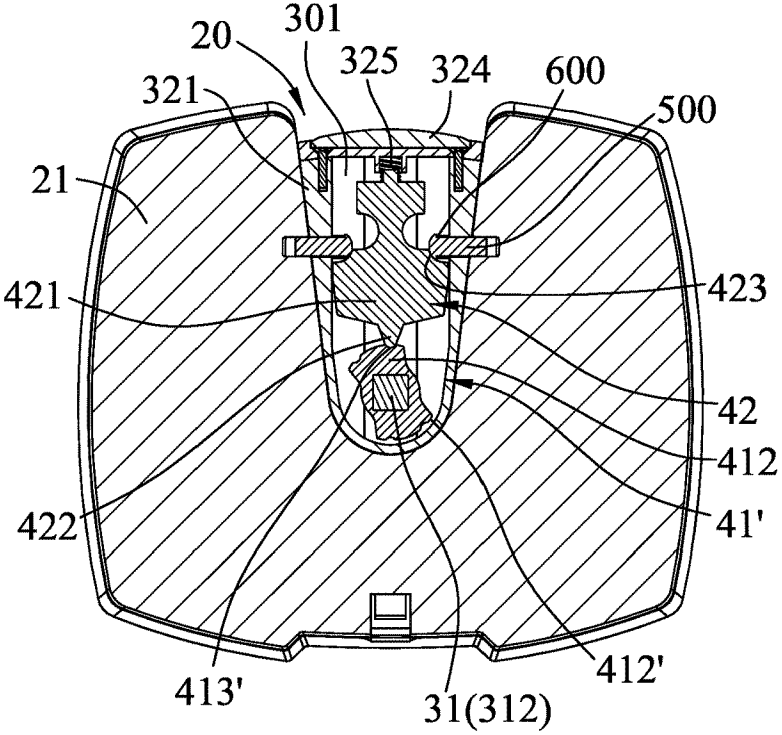
FIG. 23 is a sectional view taken along line N-N of FIG. 21.
Figure 22:
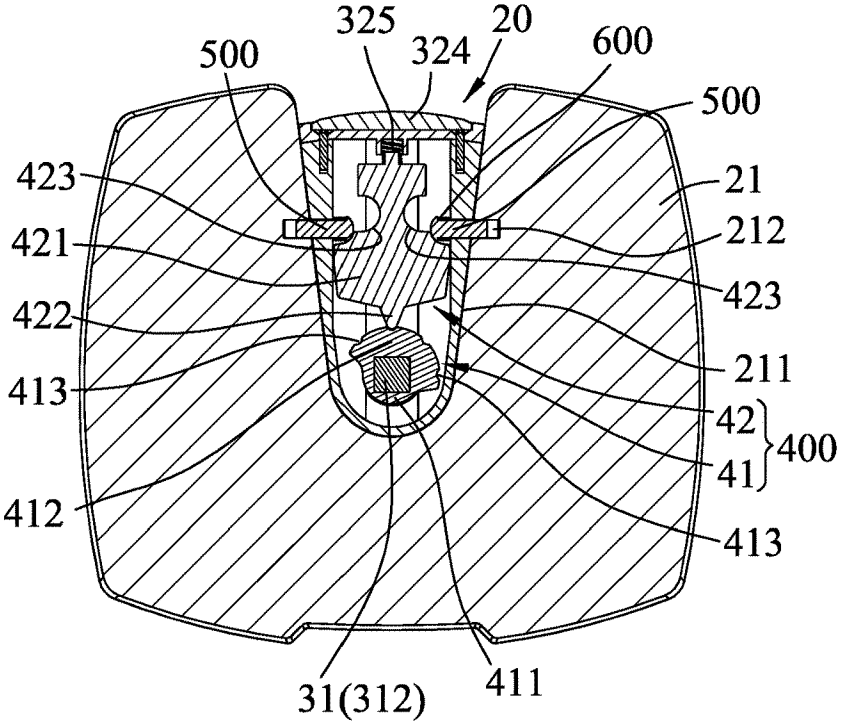
FIG. 22 is a sectional view taken along line M-M of FIG. 21.
Figure 24:
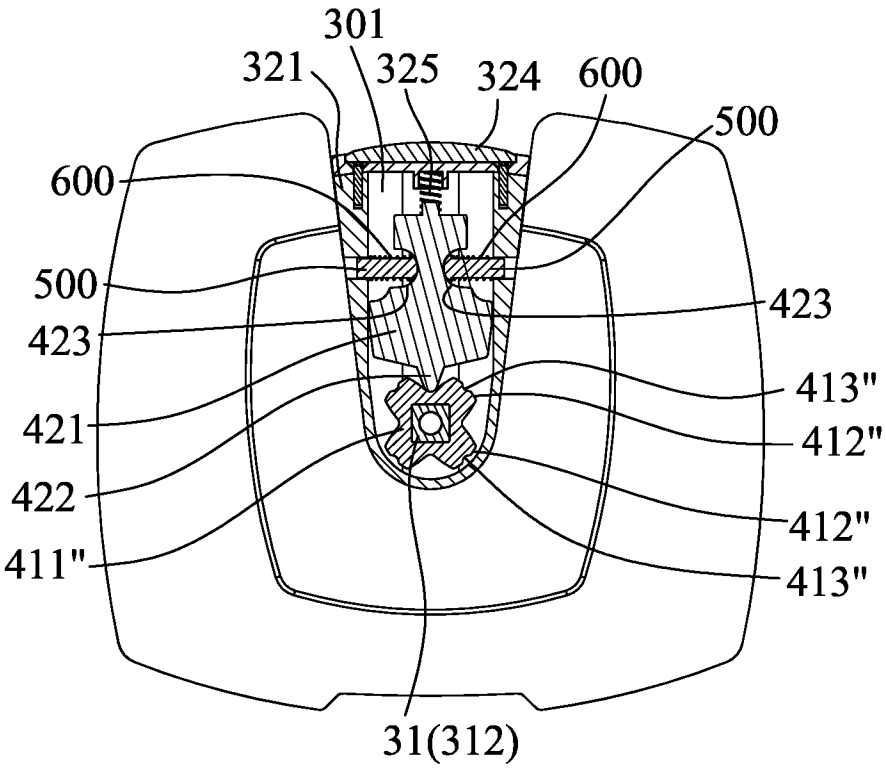
FIG. 24 is a sectional view taken along line O-O of FIG. 21.
Figure 25:
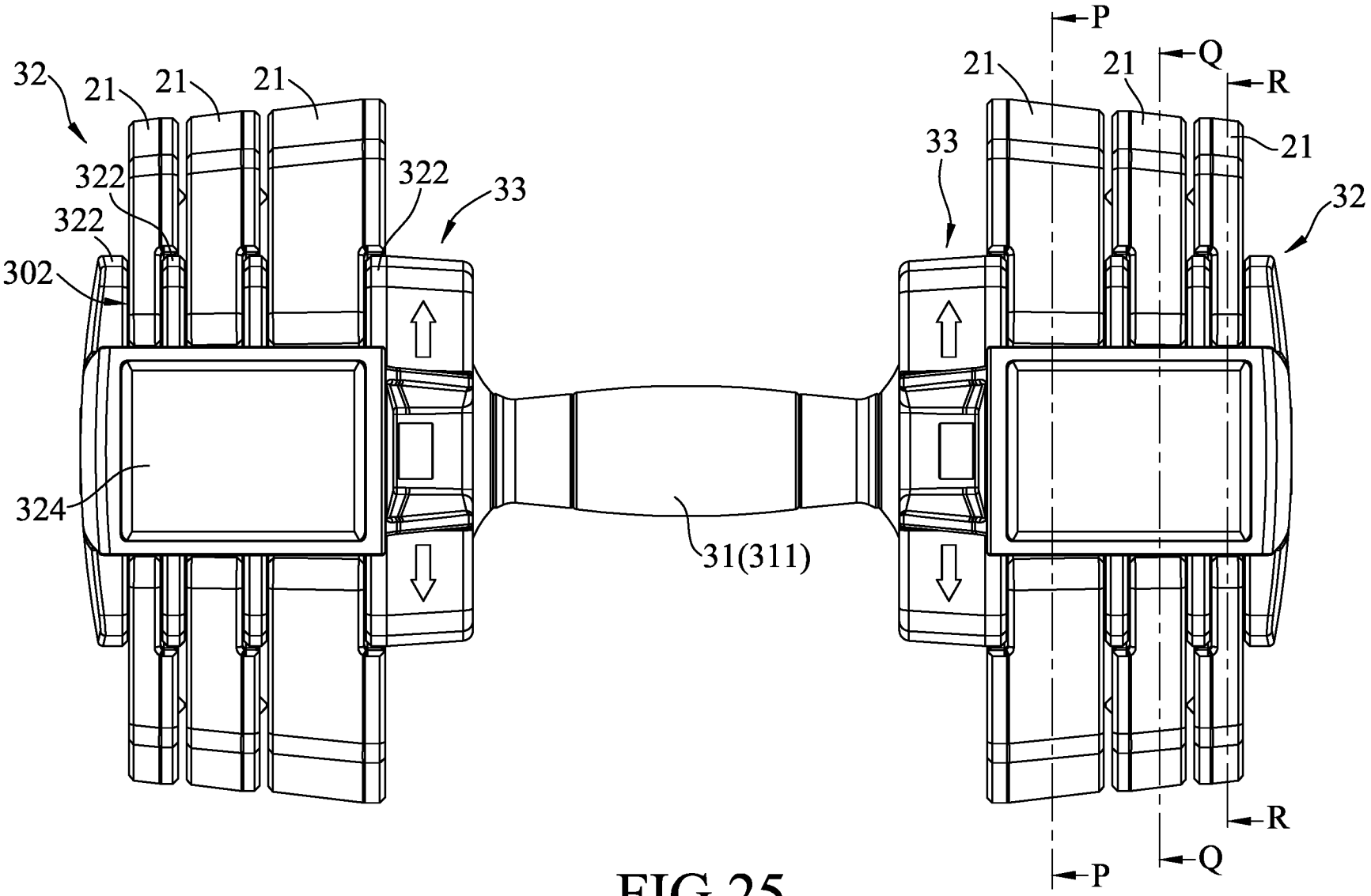
FIG. 25 is a view similar to FIG. 4, but with each side of the dumbbell being mounted with three weight blocks of the corresponding weight unit.
Figure 27:
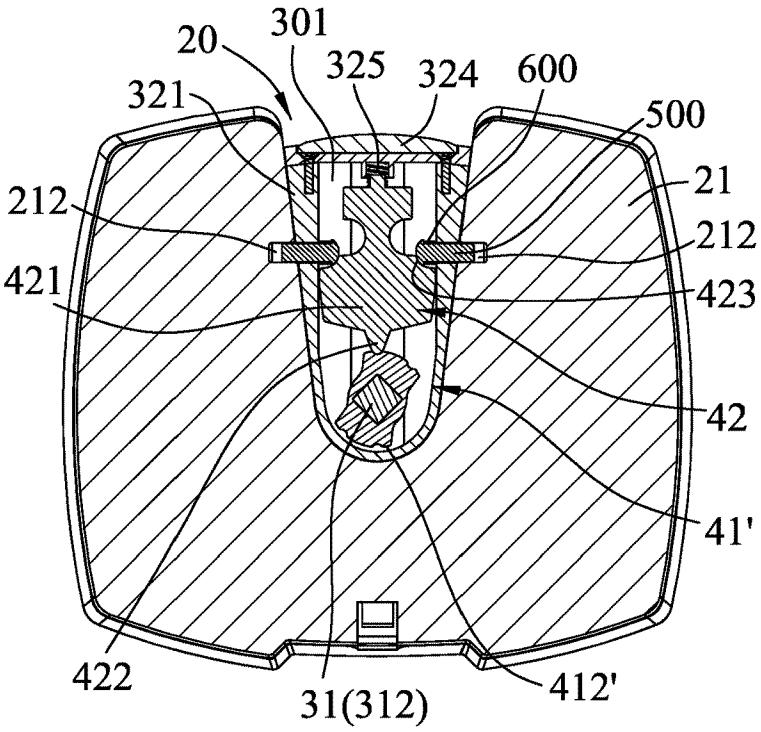
FIG. 27 is a sectional view taken along line Q-Q of FIG. 25.
Figure 26:
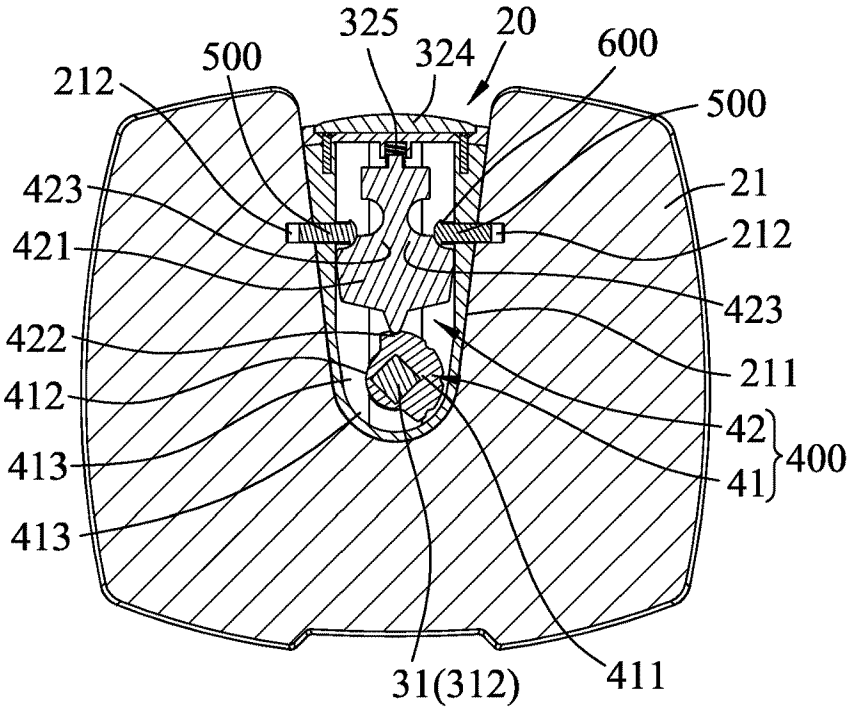
FIG. 26 is a sectional view taken along line P-P of FIG. 25.
Figure 28:
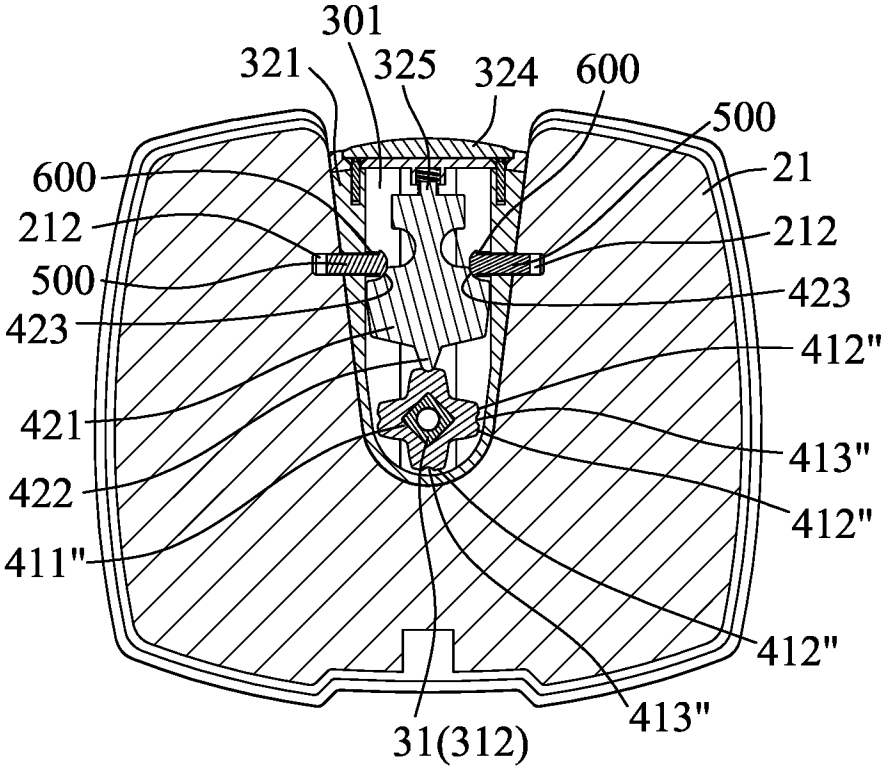
FIG. 28 is a sectional view taken along line R-R of FIG. 25.

Referring to FIG. 12, in combination with FIG. 7, the engaging unit 323" will be illustrated hereinafter. The engaging unit 323" can be driven by rotation of the handle 31 to move between an engaging state and a disengaging state. When the engaging unit 323" is moved from the disengaging state (see FIG. 7) to the engaging state (see FIG. 12), the drive block 41" is rotated with one of the arms 4111 pushing upward the abutment portion 422 of the driven block 42 until the abutment portion 422 moves over one of the protruding portions 412" and falls into and engages with the positioning recess 413", thereby driving the driven main body 421 to move upward relative to the insertion base 321 and relative to the insertion pins 500. At this time, the insertion pins 500 are moved away from the respective guide notches 423 and are pushed by the notch-defining surfaces 4231 of the guide notches 423 to move until the shank portions 51 thereof protrude out of the insertion base 321 and engage with the respective engaging holes 212 of the weight block 21, thereby connecting the insertion base 321 with the weight block 21. Simultaneously, the first elastic member 325 is compressed by the driven main body 421 to store a restoring force, and presses downward the abutment portion 422 to abut against the positioning recess 413 and prevent the same from slipping therefrom, thereby fixing the engaging unit 323" in the engaging state. The second elastic members 600 are compressed due to outward movement of the insertion pins 500, and store restoring forces.

To switch the engaging unit 323" from the engaging state to the disengaging state, the handle 31 is rotated to drive rotation of the drive block 41" relative to the driven block 42 so as to move the abutment portion 422 out of the positioning recess 413" and move over the one of the protruding portions 412" to a position between two adjacent ones of the arms 4111. At this time, the upward pushing force on the driven block 42 is released, and the restoring force of the first elastic member 325 is also released and biases the driven block 42 to move downward relative to the insertion pins 500 to fix the engaging unit 323" in the disengaging state. At the same time, the restoring forces of the second elastic members 600 are also released and respectively bias the head portions 52 of the insertion pins 500 to move into the respective guide notches 423 and gradually retract the shank portions 51 of the insertion pins 500 into the insertion base 321 and away from the respective engaging holes 212 of the weight block 21, thereby disconnecting the insertion base 321 with the weight block 21.

Since the relative positions of the drive blocks 41, 41', 41" are fixed, when the drive blocks 41, 41', 41" are driven to rotate by the handle 31, specific areas of the drive blocks 41, 41', 41" can be selected to face upward to a state that the protruding portions 412, 412', 412" can interact with the abutment portions 422 of the driven blocks 42. As such, the engaging units 323 can be switched respectively and independently between the engaging state and the disengaging state.

Referring again to FIGS. 2 and 3, the anti-rotation modules 33 are mounted on the two opposite ends of the shaft portion 312 of the handle 31, and respectively face the weight adjustment modules 32. Each anti-rotation module 33 includes an outer casing 331, and a rotary disc 332 rotatably fixed to the outer casing 331. Before the insertion base 321 of each weight adjustment module 32 of the dumbbell 3 is inserted into the insertion grooves 20 of the weight blocks 21 of the corresponding weight unit 2, the anti-rotation modules 33 can prevent rotation of the handle 31 relative to the weight adjustment modules 32; and, after the insertion base 321 of each weight adjustment module 32 of the dumbbell 3 is inserted into the insertion grooves 20 of the weight blocks 21 of the corresponding weight unit 2, the anti-rotation modules 33 are activated by the respective projections 13 so as to permit rotation of the rotary disc 332 and the handle 31 relative to the weight adjustment modules 32 for switching the states of the engaging units 323, 323', 323". Since the anti-rotation modules 33 are not the main aspect of this disclosure, a detailed description thereof will be omitted herein.

With reference to FIGS. 1 and 2, to use this embodiment, the weight units 2 are first placed in the receiving areas 12, after which the insertion bases 321 of the weight adjustment modules 32 of the dumbbell 3 are inserted downwardly into the insertion grooves 20 of the weight blocks 21 so as to be disposed at a state shown in FIG. 1. At this time, the projections 13 of the base seat 1 respectively activate the anti-rotation modules 33, so that the user can rotate the handle 31 relative to the weight adjustment modules 32.

With reference to FIGS. 4 to 7, when the user intends to use the lightest weight, that is, the dumbbell 3 is not connected with any of the weight blocks 21, the user rotates the grip portion 311 of the handle 31 for adjusting the drive main body 411, 411', 411" such that the protruding portions 412, 412', 412" thereof do not face upward, so that all of the engaging units 323, 323', 323" are in the disengaging state. When the user lifts up the handle 31, all the weight blocks 21 are not connected to the weight adjustment modules 32 and all remain in the respective receiving grooves 121, so that the user can obtain the lightest weight of the dumbbell 3.

Referring to FIGS. 9 to 12, if the user intends to change the weight, for instance, he/she intends to connect only the outermost weight blocks 21 of the weight units 2 to obtain the second lightest weight, the dumbbell assembly of this disclosure is first restored to the state shown in FIG. 1, after which the grip portion 311 of the handle 31 is rotated to move one of the pairs of the protruding portions 412" of the drive blocks 41" to face upward, and only the most outermost engaging units 323" are switched to the engaging state, while the other engaging units 323 and 323' remain in the disengaging state. After the adjustment, when the user lifts up the handle 31, he/she can obtain the desired weight of the outermost weight blocks 21.

Referring to FIGS. 13 to 16, the handle 31 is rotated to adjust the protruding portions 412' on one of the short sides of the drive main bodies 411' of the drive blocks 41' to face upward, so that only the middle ones of the weight blocks 21 can be connected to the weight adjustment modules 32, or referring to FIGS. 17 to 20, only the innermost ones of the weight blocks 21 can be connected to the weight adjustment modules 32, so that different weight effects can be achieved by connecting with different weight blocks 21.

Referring to FIGS. 21 to 24, similarly, by rotating the grip portion 311 of the handle 31, the middle engaging units 323' and the innermost engaging units 323 can be simultaneously switched to the engaging state, while the outermost engaging units 323" are switched to the disengaging state, so that each weight adjustment module 32 is connected with two weight blocks 21, thereby achieving a heavier weight. Of course, the grip portion 311 of the handle 31 may be rotated such that only the outermost engaging units 323" and the middle engaging units 323' are simultaneously switched to the engaging state, or only the outermost engaging units 323" and the innermost engaging units 323 are simultaneously switched to the engaging state, so that different combinations of two weight blocks 21 connected to the weight adjustment modules 32 can be achieved.

Referring to FIGS. 25 to 28, the grip portion 311 of the handle 31 is rotated such that specific protruding portions 412, 412', 412" of the drive main body 411, 411', 411" face upward, so that the engaging units 323, 323', 323" are all switched to the engaging state, and all the weight blocks 21 are connected to the weight adjustment modules 32, thereby achieving the heaviest weight of the dumbbell 3.

It is worth to mention herein that, in this embodiment, the weight blocks 21 of each weight unit 2 have different widths in the left-right direction (X) and different weights. The widths of the receiving grooves 121 corresponding to the weight blocks 21 are also correspondingly changed. However, in practice, it is not limited thereto. The sizes of the weight blocks 21 and the receiving grooves 121 may be the same, and will not affect the effect of weight adjustment. Moreover, the number of the weight blocks 21 of each weight unit 2 is not limited to three, it may be two or four. Matching the number corresponding to the engaging units 323, 323', 323" and adjusting the number of the protruding portions 412, 412', 412" of the drive blocks 41, 41', 41" and the structures of the overlapping and non-overlapping portions can similarly achieve the effect of weight adjustment.

It should be noted herein that, each weight block 21 has two engaging holes 212, and each engaging unit 323, 323', 323" has two insertion pins 500 insertable into the respective engaging holes 212 in the front-rear direction (Y), apart from providing more stable connection, the balance of the overall structure can also be maintained. However, in practice, it is not limited thereto. In other variations of this embodiment, each weight block 21 may have only one engaging hole 212, and each engaging unit 323, 323', 323" may have only one insertion pin 500 insertable into the engaging hole 212. The connection effect between the weight adjustment module 32 and the weight block 21 can still be achieved.

In sum, the effect of the dumbbell assembly of this disclosure resides in: through the structural design of the protruding portions 412, 412', 412" of the drive blocks 41, 41', 41", all or a portion of the engaging units 323, 323', 323" can be driven to the engaging state or the disengaging state so as to facilitate the user in selecting different weights of weight blocks 21, thereby achieving the purpose of adjusting the weight of the dumbbell 3. Further, the connection of each engaging unit 323, 323', 323" with each weight block 21 is achieved through the insertion of the insertion pins 500 into the engaging holes 212 of the weight block 21, replacing the existing weight block which requires an additional connection with a hook protrusion before it could be connected to the dumbbell, and avoiding the situation where the hook protrusion may break and the weight block may detach. Moreover, each weight block 21 is connected with two insertion pins 500, so even if one of the insertion pins 500 is broken, the weight block 21 will not drop to the ground immediately. Anew insertion pin 500 replaces the broken one, and there is no need to replace the entire weight block 21. Not only the weight adjustment modules 32 and the weight blocks 21 can be safely connected to each other, but also the maintenance cost can be significantly reduced.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A dumbbell assembly comprising:

a base seat extending along a left-right direction, and including a main seat body which has two receiving areas formed in a top surface thereof and spaced apart from each other in the left-right direction, each of said receiving areas having a plurality of receiving grooves arranged spaced apart from one another along the left-right direction;

two weight units respectively disposed in said receiving areas, each of said weight units including a plurality of weight blocks received respectively and removably in said receiving grooves of a respective one of said receiving areas, each of said weight blocks having at least one engaging hole; and a dumbbell including a handle extending in the left-right direction, and two weight adjustment modules respectively disposed on two opposite ends of said handle and respectively corresponding to said weight units, each of said weight adjustment modules including an insertion base that defines a plurality of adjustment spaces arranged spaced apart from one another along the left-right direction, and a plurality of engaging units respectively received in said adjustment spaces and respectively corresponding to said weight blocks of a respective one of said weight units, each of said engaging units including a drive component mounted on said handle, and at least one insertion pin resiliently connected to said drive component and corresponding to said at least one engaging hole;

wherein, when said handle is rotated relative to said weight adjustment modules, said handle drives each of said engaging units to move between an engaging state and a disengaging state;

when each of said engaging units is in said engaging state, said at least one insertion pin is driven by said drive component to protrude out of said insertion base and engage with said at least one engaging hole in a corresponding one of said weight blocks, thereby connecting said insertion base with the corresponding one of said weight blocks; and when each of said engaging units is in said disengaging state, said at least one insertion pin is retracted into said insertion base and is moved away from said at least one engaging hole in the corresponding one of said weight blocks, thereby disconnecting said insertion base with the corresponding one of said weight blocks.

2. The dumbbell assembly as claimed in claim 1, wherein:

said handle includes a grip portion, and a shaft portion extending through said grip portion and having two opposite ends;

said drive component of each of said engaging units has a drive block sleeved on one of the ends of said shaft portion and driven to rotate by said handle, and a driven block superposed on and abutting against said drive block, said driven block being driven to move up and down relative to said drive block when said drive block is rotated by said handle;

said drive block has a drive main body, and at least two spaced-apart protruding portions protruding outwardly from an outer periphery of said drive main body, said driven block having a driven main body, and an abutment portion protruding downwardly from said driven main body and abutting against said drive block, said driven main body having two guide notches opposite to each other in a front-rear direction which is transverse to the left-right direction, each of said guide notches being defined by a notch-defining surface;

said at least one insertion pin is disposed in one of said guide notches and abuts against said notch-defining surface of said one of said guide notches when each of said engaging units is in said disengaging state; and when each of said engaging units is switched from said disengaging state to said engaging state, said drive block is rotated by said handle to push said abutment portion of said driven block so as to move upward said driven main body and to move said at least one insertion pin away from said one of said guide notches, said at least one insertion pin being pushed by said notch-defining surface of said one of said guide notches to protrude out of said insertion base and engage said at least one engaging hole in the corresponding one of said weight blocks.

3. The dumbbell assembly as claimed in claim 2, wherein said drive block further has a positioning recess extending inwardly from said outer periphery and located between said at least two protruding portions, and wherein, when each of said engaging units is in said engaging state, said abutment portion of said driven block is engaged with said positioning recess.

4. The dumbbell assembly as claimed in claim 3, wherein said drive block has a plurality of said protruding portions and a plurality of said positioning recesses each of which is located between two adjacent ones of said protruding portions, and wherein, when each of said engaging units is in said engaging state, said abutment portion of said driven block is releasably engageable with one of said positioning recesses.

5. The dumbbell assembly as claimed in claim 2, wherein said drive blocks of said engaging units of each of said weight adjustment modules are overlapped along said shaft portion of said handle in the left-right direction with said protruding portions of said drive blocks blocking one another.

6. The dumbbell assembly as claimed in claim 2, wherein at least one of said drive blocks of said engaging units of each of said weight adjustment modules has a plurality of said protruding portions.

7. The dumbbell assembly as claimed in claim 2, wherein each of said weight adjustment modules further includes a top cover mounted on said insertion base and covering said adjustment spaces, and a plurality of first elastic members each of which is disposed between said top cover and one of said driven blocks of said engaging units, each of said first elastic members elastically biasing said one of said driven blocks downwardly to fix each of said engaging units to the disengaging state.

8. The dumbbell assembly as claimed in claim 2, wherein each of said engaging units includes a plurality of said insertion pins, each of said insertion pins having a head portion abutting against said notch-defining surface of said one of said guide notches, and a shank portion extending outwardly from said head portion into said insertion base along the front-rear direction, each of said engaging units further including a plurality of second elastic members each of which is sleeved on said shank portion of a respective one of said insertion pins and resiliently abutting between said insertion base and said head portion of the respective one of said insertion pins, and wherein, when each of said engaging units is switched from the engaging state to the disengaging state, each of said second elastic members biases said head portion of the respective one of said insertion pins to move into said one of said guide notches and retract said shank portion of the respective one of said insertion pins into said insertion base.

9. The dumbbell assembly as claimed in claim 2, wherein each of said weight blocks has a groove wall defining a substantially U-shaped insertion groove that extends inwardly from an upper end thereof for insertion of a corresponding one of said weight adjustment modules thereinto, each of said weight blocks having two said engaging holes formed in two opposite sides of said groove wall, each of said engaging units having two said insertion pins respectively received in said guide notches of said driven block, said insertion pins being respectively insertable into said engaging holes when each of said engaging units is in the engaging state.

10. The dumbbell assembly as claimed in claim 1, wherein each of said weight adjustment modules further includes a plurality of limiting plates spaced apart from one another along the left-right direction, each two adjacent ones of said limiting plates cooperating with said insertion base to define a mounting space for receiving a corresponding one of said weight blocks.

* * * * *